US005140887A

United States Patent [19]

Chapman

[11] Patent Number: 5,140,887

[45] Date of Patent: Aug. 25, 1992

[54] STRINGLESS FINGERBOARD SYNTHESIZER CONTROLLER

[76] Inventor: Emmett H. Chapman, 6011 Woodlake Ave., Woodland Hills, Calif. 91367-3238

[21] Appl. No.: 761,472

[22] Filed: Sep. 18, 1991

[51] Int. Cl.[5] ..... G10H 1/34; G10H 3/18

[52] U.S. Cl. ..... 84/646; 84/658; 84/DIG. 7; 84/DIG. 30; 84/314 R

[58] Field of Search ..... 84/646, 647, 653, 658, 84/662, 663, 670, DIG. 30, DIG. 11, DIG. 7, 314 R, 722, 744, 745

[56] References Cited

U.S. PATENT DOCUMENTS

| | | | |
|---|---|---|---|
| 3,555,166 | 1/1971 | Gasser | 84/646 |
| 3,662,641 | 5/1972 | Allen et al. | 84/646 |
| 3,842,702 | 10/1974 | Tsundoo | 84/DIG. 11 |
| 4,336,734 | 6/1982 | Polson | 84/DIG. 30 |
| 4,570,521 | 2/1986 | Fox | 84/DIG. 30 |
| 4,580,479 | 4/1986 | Bonanno | 84/646 |
| 5,033,351 | 7/1991 | Nomura | 84/646 |
| 5,085,119 | 2/1992 | Cole | 84/DIG. 30 |

*Primary Examiner*—William M. Shoop, Jr.
*Assistant Examiner*—Helen Kim
*Attorney, Agent, or Firm*—J. E. McTaggart

[57] ABSTRACT

Strings and frets are simulated in a resilient fingerboard controller for synthesizer-type musical instruments. Raised string-faces and fret-faces simulate the feel of conventional strings and frets. Embedded sensor strips connect to an external customized encoder. In operation, notes are selected in the manner of conventional guitar fret-stopping but with either hand or both hands simultaneously. The pitch of each note is under real time control of the player's finger tips via pressure exerted in either lateral direction against the simulated strings, bending the pitch upward in proportion to the amount of such pressure in either direction as is usual in stringed instruments, or, alternatively, bending the pitch up or down depending on the direction of the pressure. Optional fret-bend sensors enable proportional control over additional effects. A series-connected sensor matrix and a bank of individual strobed string-face encoders provide full all-string polyphony; alternatively, a parallel sensor matrix and multi-encoder may be made to provide a lesser degree of polyphony for simplification and economy. MIDI formatting of the encoder output provides wide compatibility with readily available musical equipment. The present invention provides special benefits when operated in conjunction with the two-handed tapping technique as practiced on the ten-string Chapman Stick* and The Grid*.

*Registered Trademakrs of Stick Enterprises, Inc.

11 Claims, 3 Drawing Sheets

STRINGLESS FINGERBOARD SYNTHESIZER CONTROLLER

FIELD OF THE INVENTION

The present invention relates to stringed and fretted electronic musical instruments which are played in the general manner of a guitar, and more particularly it relates to a fingerboard structure in which the scope of musical control available to a player is greatly expanded, by replacing conventional strings with simulated string-faces made integral with the fingerboard and sensed electronically at fret domains to provide input to an encoder and thence to a processor or synthesizer. The invention provides potential improvement for various fretted instrumental and fingerboard techniques such as regular guitar playing, and is particularly compatible with two-handed tapping techniques.

BACKGROUND OF THE INVENTION

In the conventional manner of playing stringed instruments such as guitars, banjos and the like, strings are pressed against frets on a fretboard or against a fretless fingerboard in order to vary the active string length and thus select the pitch (i.e. frequency) of the note to be played; normally the left hand forms notes and chords while the strings are picked, plucked, strummed or bowed with the right hand which predominantly controls amplitude envelope parameters, particularly the dynamics of each note, such as attack and loudness. This basic approach has been carried over from the purely acoustic category of instruments to the great majority of electronically-amplified stringed instruments in present use, notably the amplified "electric guitar". Even in the more technically sophisticated category of "guitar synthesizers" this traditional string-and-fret system is commonly utilized as the actual interface with the musician; string vibrations are sensed in an pickup whose analog electrical output is converted to a "synthesizer language" such as MIDI, the widely adopted Musical Instrument Digital Interface standards, for further electronic processing into synthesized sounds.

In a departure from the conventional approach of fingering the strings with one hand while strumming or plucking strings with the other hand, a stringed instrument trademarked as The Chapman Stick, introduced in 1974 and disclosed in U.S. Pat. Nos. 3,833,751 and 3,868,880 to Chapman, is played with both hands on the fingerboard; a musical note is initiated by tapping a string against a fret with either hand as opposed to strumming or plucking. This playing technique in conjunction with magnetic string pickups has been practiced using The Stick with analog power amplification and in a synthesizer controller version, trademarked as The Grid, where the pickup signals are MIDI-encoded to facilitate a variety of digital/analog electronic effects. A LAYERED VOICE MUSICAL SELF ACCOMPANIMENT METHOD, for which The Stick and The Grid are particularly well suited, is disclosed in U.S. Pat. No. 4,922,797 to Chapman.

A special requirement of two-handed string tapping technique as taught by Chapman is the need for control over the amplitude envelope, for musical expression, at the same fingertip interface, i.e. the fingerboard, which provides the basic function of pitch selection as each note is played with either hand at the fretboard; this is a fundamental departure from conventional techniques where one hand normally provides pitch selection at the fingerboard while the other hand is mainly dedicated to forming and controlling the amplitude and expression through strumming, picking or plucking motions.

The difficulties and limitations of manufacturing, maintaining and playing conventional string-and-fret instruments are well known, and have prompted numerous efforts to develop alternative approaches which exploit the capabilities of electronic technology. The concept of a stringless fingerboard implemented by electronics overcomes many of these difficulties and limitations which are inherently mechanical in origin. Electronic technology has provided the potential of greatly enhanced control over the various amplitude envelope parameters such as attack, decay, sustain and release, which in mechanical acoustic instruments are subject to severe limitations imposed by the mechanical constraints of the string-and-fret instrument and require a great deal of practice and skill on the part of the player in attempting to develop a degree of control over the envelope through a combination of fingerboard technique with one hand and picking/plucking/bowing technique with the other hand. The ease with which electronics can control envelope parameters in real time facilitates implementation of the concept of a two-handed playing technique wherein a wide range of envelope control capability is provided instantly at each fingertip by advanced human-machine interfacing at a stringless playing surface.

"Stringless" fingerboards which have been proposed in known art have predominantly addressed only the conventional techniques of using only one hand on the fingerboard for selecting pitch. Within this category, U.S. Pat. Nos. 4,339,979 to Norman, 4,177,705 to Evangelista, and 3,340,343 to Woll require some form of strumming or plucking to be performed by one hand, while in U.S. Pat. Nos. 3,555,166 to Gasser and 4,570,521 to Fox, a piano-type keyboard is to be played by one hand while the other plays the fingerboard or fretboard. Eventoff U.S. Pat. Nos. 4,235,141 and Suzuki et al 3,694,559 disclose fingerboards in which pitch is varied by variable resistance. These approaches and others of known art have been directed to one-handed fingerboard techniques which utilize the fingerboard solely for pitch selection, and thus have failed to address fingerboard control of amplitude envelope parameters, in particular attack velocity, as required for two-handed fingerboard techniques addressed by the present invention.

In playing conventional string-and-fret type instruments, musicians often use a technique known as "pitch bending": a note which has been selected by holding a string against a fret is "bent", i.e. shifted to a higher pitch, by pushing the string laterally along the fret in either direction from its normal position so as to increase the string tension and thus increase the resonant vibration frequency of the string. The pitch cannot be bent to a lower pitch in this manner; however, as a partial remedy to this shortcoming, some instruments are provided with a string tensioning lever, usually operated by the plucking/strumming hand, by which the overall string tension can be varied in either direction, affecting all the strings. This inability to bend the pitch of individual strings downward using the string-and-fret hand is clearly an inherent limitation imposed by the mechanical nature of conventional instruments, and has not been heretofore remedied by known art in either stringed or stringless approaches.

The mechanics of the conventional string-and-fret fingerboard basically restricts finger control to only two dimensions: (1) downwardly, as the string is pressed against a fret in a virtually binary (i.e. on-off) function, and (2) laterally, as the string is stretched sideways to obtain a limited and inflexible degree of upward pitch bending in either of the two opposed lateral directions. However the player's fingers, if suitably interfaced, are capable of movements in other directions which may be utilized advantageously to control various musical effects or parameters such as sustain, reverberation, timbre, etc., directly at the player's fingertips, in a significant extension of the conventional playing techniques of simple note selection and limited pitch bending.

OBJECTS OF THE INVENTION

It is a primary object of the present invention to provide an improved fingerboard and associated encoding electronics to act as a controller for a stringless guitar-like and/or bass-like musical instrument, wherein, in addition to a basic capability of pitch selection in half tone steps similar to conventional string-and-fret technique, a musician is provided with the additional novel capability of controlling amplitude envelope parameters through manipulation of a simulated string-and-fret grid on the fingerboard, as a departure from conventional practice where such amplitude parameters must be controlled apart from the fingerboard in some form of strumming or plucking mechanism which fully occupies one of the musician's hands while the other hand manipulates the fingerboard.

It is a further object to provide such a fingerboard configured in a manner to facilitate playing the instrument with a two-handed tapping technique in which both hands manipulate the fingerboard, each hand independently playing notes in a finger-tapping manner.

It is a further object that the fingerboard controller provide the additional capability of pitch-bending any selected note in response to sideways pressure against a simulated string.

It is a still further object to provide a selectable capability of bending the pitch either upwardly or downwardly at will.

It is a still further object to variably manipulate and control other effects or parameters of the note played by applying pressure against simulated frets in either direction along the string axis.

SUMMARY OF THE INVENTION

The above-mentioned objects have been accomplished in this invention through the concept of a stringless fingerboard controller having a resilient structure with raised longitudinal string-faces simulating conventional strings and having subdominantly raised fret-faces simulating conventional frets. Embedded sensor strips are connected to electronic encoding and processing means such as synthesizers. In performance, a musician, after initially selecting the pitch of a note by visual and/or tactile finger sensing of the simulated string-and-fret structure in the general manner of conventional guitar playing, is enabled to exert control over the amplitude envelope (attack, decay, sustain, release, etc.) of the note via fingertip pressure on the string-face toward the fingerboard surface, and to bend the pitch via lateral pressure against a string-face, in a choice of upward, downward or bidirectional pitch-bending modes.

Furthermore, embodiments of this invention may take advantage of the resilient fingerboard controller and cooperating electronics to achieve further sensing dimensions for fingertip control of additional musical effects and parameters by providing bidirectional response to longitudinal pressure against the fret-faces along the axis of the stringfaces.

BRIEF DESCRIPTION OF THE DRAWINGS

The above and further objects, features and advantages of the present invention will be more fully understood from the following description taken with the accompanying drawings in which.

DETAILED DESCRIPTION

Figure 1:
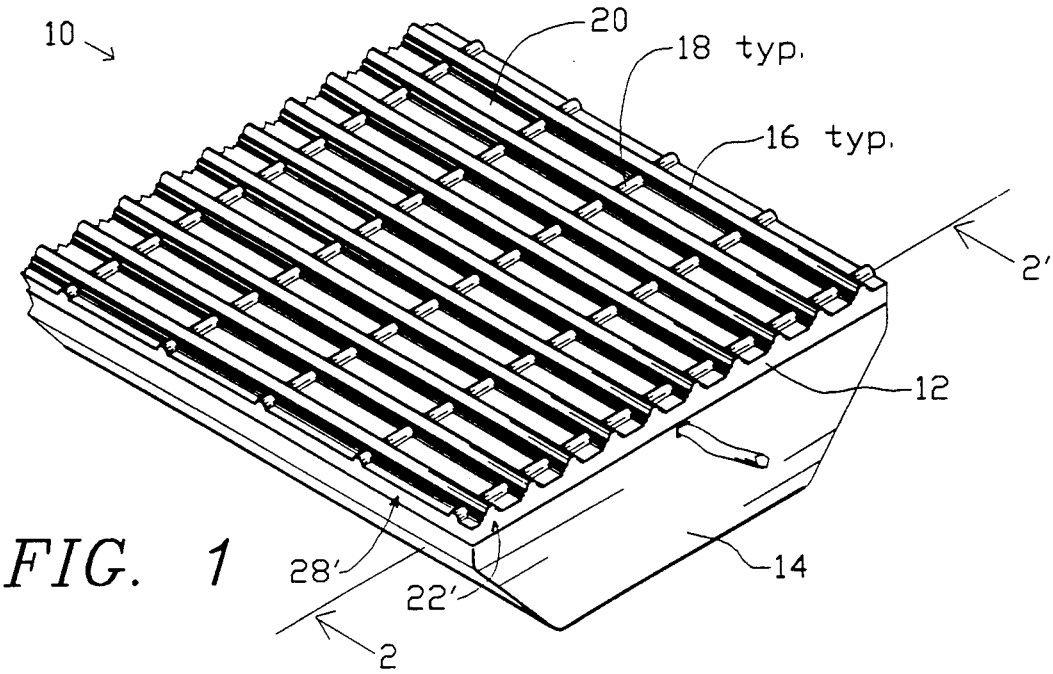
FIG. 1 is a three-dimensional view of a cutaway end portion of a resilient stringless fingerboard controller of the present invention.

In FIG. 1, the three-dimensional view shows a cutaway end portion of an elongated resilient stringless fingerboard controller according to the present invention in an illustrative embodiment. The fingerboard controller assembly 10 comprises a resilient fingerboard 12, shown facing upwardly, having a flat rear surface affixed to a flat front surface of an elongated rigid rear board 14, which may be made from a suitable material such as plastic or wood. The playing surface at the front of the resilient fingerboard 12 is configured with an array of parallel longitudinal predominantly raised string-faces 16 and transverse subdominantly raised fret-faces 18 each comprising a row of fret-face members extending between adjacent string-faces. Each fret-face 18 corresponds to a conventional fret, however the interfret spacing may be made equal and optimized to facilitate fingering in contrast to the unequal interfret spacing required in conventional stringed fingerboards which is strictly dictated by active string length demands. The playing surfaces of string-faces 16 and fret-faces 18 are made half round to simulate the playing "feel" of conventional strings and frets.

The entire resilient fingerboard 12 may be molded in one integral piece; alternatively it may be made in two or more portions separably joined so as to provide access to the sensors without removal of a portion attached to the rear board.

Embedded in the resilient fingerboard 12 are string sensors, each in the form of an elongated strip retained in a longitudinal channel running parallel beneath a corresponding string-face 16, and fret sensors, each extending across the fingerboard retained in a transverse channel substantially perpendicular to the string sensors, the fret sensors being located typically at playing domains between adjacent fret-faces. In FIG. 1, the approximate locations of the nearest fret sensor and string sensor, as projected to outer surfaces of fingerboard 12, are indicated by arrows 28' and 22' respectively.

Each cell 20 formed between intersecting string-faces 16 and fret-faces 18 may be occupied by a recessed flat surface, formed in the resilient material of fingerboard 12, adhesively attached to the front surface of the rigid rear board 14. Alternatively the cells 20 could be left open exposing the rear board surface.

Electrical wiring from the sensor strips may be routed along a channel provided in rear board 14 running longitudinally along a central region of the top surface, with the wiring exiting at one end in the form of a cable, as indicated, which may be fitted with a suitable plug for connection to encoding and processing equipment. Alternatively the wiring from the sensor strips could be set into one or more channels or grooves formed in the fingerboard 12, or could be formed as flat ribbon cable or conductors sandwiched between the fingerboard 12 and the rear board 14.

Figure 2:
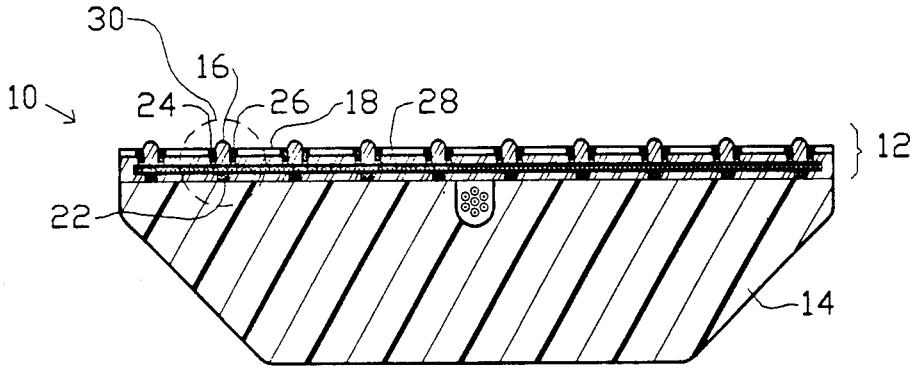
FIG. 2 is a cross section taken through axis 2—2' of FIG. 1.

FIG. 2 shows a cross section of the fingerboard controller assembly 10 of FIG. 1, taken at axis 2—2' which is the location of the first fret sensor: between the first and second fret-faces. The string-faces 16 protrude as shown. Embedded in channels on the back of the fingerboard 12 under each string-face 16 and supported against the front surface of the rear board 14, is located a string sensor 22. Embedded in channels running parallel along each side of each string-face 16, a pair of string-bend sensors 24 and 26 each made responsive to side finger pressure applied to string-faces 16. Between each pair of fret-faces 18 is a fret sensor 28, set into a transverse channel in the fingerboard 12 running across in front of the string sensors 22. Sensors 22, 24, 26 and 28 are typically of a resilient structure having a pressure-sensitive resistive element sandwiched between a pair of longitudinal conductive contact strips bonded to opposite sides of the element.

Pitch is selected on any string-face by finger-pressing (or thumb-pressing) a playing domain of a string-face 16 between adjacent fret-faces 18 in a manner similar to that of conventional string playing technique. The playing domain is defined by the fingerboard structure as a portion of the interfret spacing along a string-face over which response to pressure occurs. Typically each playing domain occupies at least half of the interfret spacing.

In a preferred embodiment directed to two-handed tapping as taught on the Chapman Stick whereby the player's two hands engage the fingerboard from opposite sides, typically ten strings and twenty five frets are simulated, thus there are ten string sensors, twenty four fret sensors with the resultant two hundred and forty playing domains.

Figure 3:
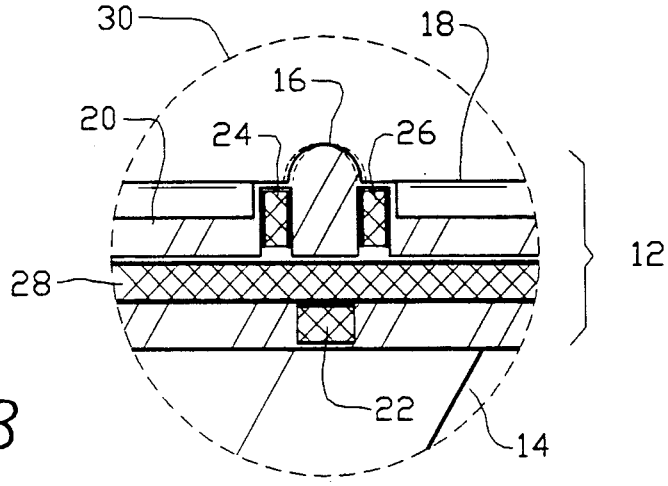
FIG. 3 is an enlarged view of a portion of FIG. 2.

FIG. 3 is an enlargement of the portion of FIG. 2 within the dashed circle 30 showing the cross section of a string-face 16 at an intersection with a fret sensor 28 which is situated on top of an intersecting string sensor 22 such that both sensors are responsive to finger pressure applied onto string-face 16 since the stacked sensors are simultaneously constrained against the rear board 14.

The string-bend sensors 24 and 26, flanking the string-face 16, are made responsive to side pressure. Due to the resilience, a small amount of bending and deflection of string-face 16 occurs as indicated by the dashed outlines.

Figure 4:
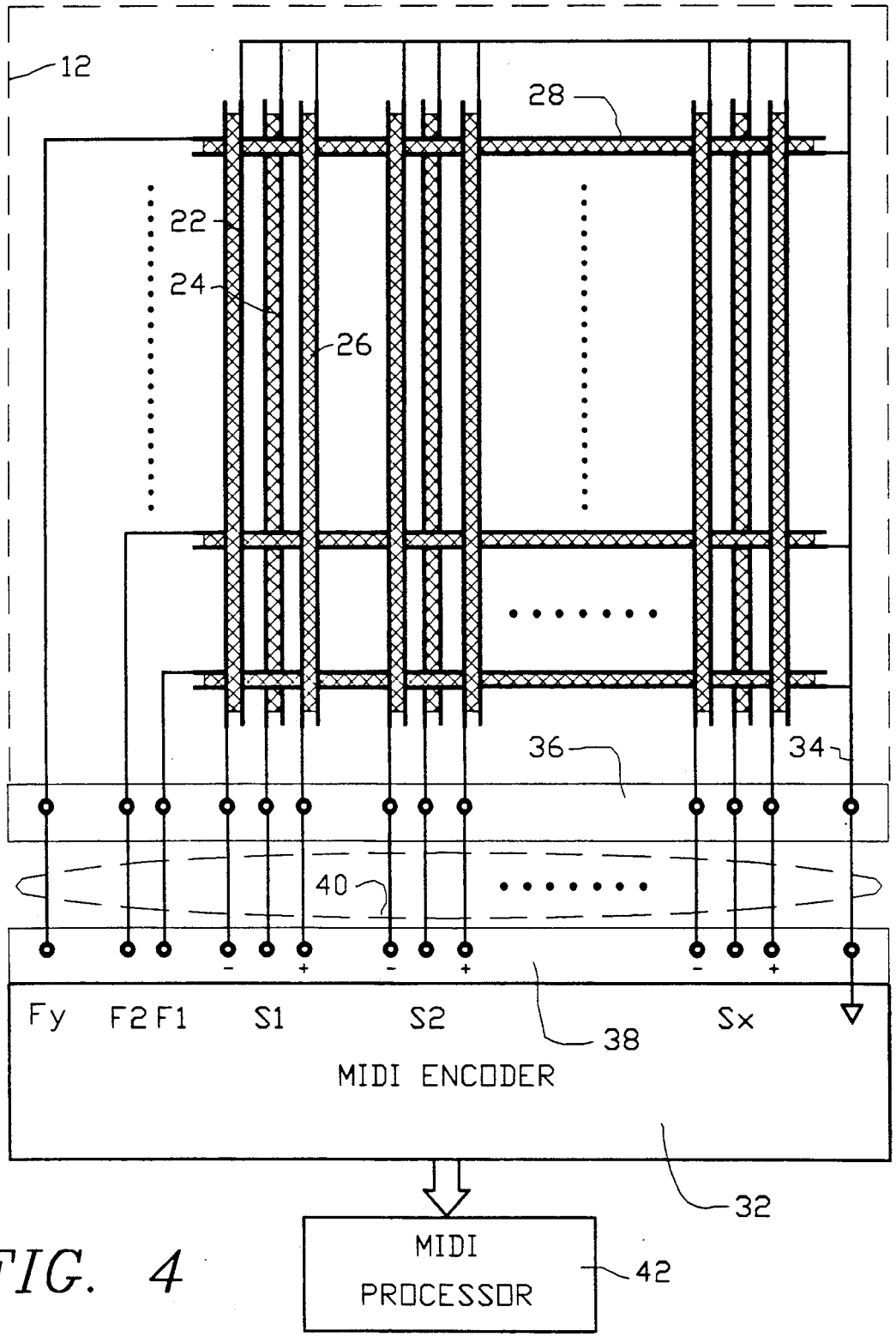
FIG. 4 is a functional block diagram of a parallel-configured fingerboard controller interfaced to an encoder unit and processor in a first embodiment of the present invention.

FIG. 4 is a simplified functional block diagram illustrating a parallel type sensor system within the resilient fingerboard assembly 12, for operation with a special encoder unit 32 followed by a processor 42.

Within the resilient fingerboard 12, indicated in dashed outline, the parallel-connected grid matrix of string sensors 22, bend sensors 24/26 and fret sensors 28 is illustrated. For simplicity and clarity, only the first, second and final one of the string columns and fret rows are shown, with the understanding that the three string columns shown represent a quantity of x similar string columns and the three fret sensor rows shown represent a quantity of y similar fret sensor rows.

Each of the sensor strips, 22, 24, 26 and 28 is seen to have two terminals: one connected to a common ground bus 34 and the other wired to a pin of a connector strip 36, which is connected to a corresponding connector strip 38 of encoder unit 32 via a multi-wire cable 40, indicated in the dashed ellipse. Via this cable 40, which may be a flat ribbon cable, each string sensor 22, associated pair of string-bend sensors 24 and 26, each fret sensor 28 and the common ground 34 are connected to the encoder 32.

Encoder 32 is specially designed to operate from the parallel connected input signals as shown and to provide a designated level of polyphony and other sophistication.

The encoder 32 should provide output in MIDI format, so that processor 42 may be selected from a wide variety of readily available MIDI-based electronic processing apparatus such as music synthesizers, tone generators and the like.

The techniques used within encoder 32 to realize particularly specified design objectives are well known to musical electronics designers. Typically the sensor elements are of the pressure sensitive resistive type: a current is passed through each sensor element, typically a direct current through a series resistor from a low voltage source in the order of 12 volts suppled from encoder 32; then as the resistance varies the resultant voltage variations are sensed as input to encoder 32, typically by a bank of voltage comparators.

Other suitable pressure sensitive materials could be utilized for forming the sensor elements, with appropriate modifications in the design of the transducing circuitry; for example, it is considered viable to utilize piezo film strips, which generate a transient voltage in response to applied pressure and are inherently velocity sensitive.

The particular configuration of encoder 32 and the extent to which the full capabilities of the fingerboard portion 12 are to be realized and exploited are matters of design choice, subject to the usual tradeoffs of cost, complexity and capability. Ideally there should be full string polyphony, i.e. the capability of independent play of all simulated strings simultaneously; this implies that for ten simulated strings, the encoder 32 and processor 42 would effectively provide ten fully independent channels and tone generators. As an example of a practical compromise, reducing the polyphony from this ideal to six or eight notes could be considered generally acceptable.

As the fingerboard controller is being played, each time a string-face is pressed at an interfret playing domain, encoder 32 senses the resultant simultaneous initial change of a string sensor voltage and a fret sensor voltage, and reads from that particular string and fret combination the particular value of pitch intended, typically formatted as the note of the half tone C scale and the octave. Then, in accordance with the finger velocity and pressure applied, amplitude information appears at both the corresponding string and the fret signal inputs. One of these, typically the string signal, is then analyzed by the encoder 32 for its key amplitude parameters from which MIDI code is generated for controlling the amplitude envelope of the synthesized version of the selected note. In a preferred embodiment, it is particularly desired to sense attack velocity: this may be realized by sensing amplitude in a comparator referenced at a second level somewhat greater than the initial level of pitch sensing and then utilizing the time delay between these two levels as the attack velocity parameter to be encoded and then sent by the encoder 32 to the processor 42 where this input attack information may be utilized to control the amplitude envelope of the resultant synthesized note in any desired manner. Alternatively, attack velocity could be sensed by two or more sets of sequential binary switch contacts provided at each playing domain, however this would greatly increase the bulk of multiple wiring required.

Sensed amplitude information may be translated into amplitude envelope shape according the well known ADSR parameters: attack, decay, sustain and release. Preferably, the sensed attack velocity is made to control the attack and decay of each note while continued fingertip pressure on the string-face, i.e. after-touch, is made to control the sustain and release of the note. Alternatively, in a simplified embodiment, sensing of attack and/or after-touch could be eliminated, and the envelope shaped according to a fixed or selectable ADSR setup.

Functionally, when amplitude information is sensed from the string sensors 22 as described above, the fret position sensor strips 28 are required to provide only a binary (on-off switch) function which is utilized for pitch determination, therefore the fret sensor function could be implemented as merely a pair of pressure-actuated switch contacts; however in the present embodiment the function is conveniently implemented as shown using a pressure-sensitive type resistive strip having a sufficiently high resistance differential to act as a "soft" switch whose point of actuation may be set by a comparator reference level at the input of encoder 32.

In the parallel system of FIG. 4 the actuation thresholds of the string sensors and the fret sensors at all of the playing domains must be closely matched to minimize the probability of errors in polyphonic performance, particularly when more than one fret-face is involved in a playing a chord of two or more notes practically simultaneously since correlating each string signal with the correct one of the fret signals relies on precise timing discrimination.

The string-bend sensors 24 and 26 operate in a manner similar to that described above for the string sensors: in FIG. 4, side pressure on the string-face associated with sensor 22 toward the left acts on sensor 24 to produce a signal voltage which is applied to the −(S1) terminal at the input receptacle 38 of encoder 32, while side pressure in the opposite direction acts on sensor 26 to produce a signal voltage which is applied to the +(S1) terminal. Encoder 38 may be set to provide a selection of different pitch-bend modes: in a unidirectional mode which simulates the upward pitch-bending of conventional guitar playing technique, the + and − signal inputs are processed in a manner to cause an increase in pitch when the string-face is pushed to either side. However in a preferred embodiment, encoder 32 is made to cause the string-bend sensors 24 and 26 to shift pitch in opposite directions to offer the player the capability of downward as well as upward pitch-bending and vibrato as a selectable option. In implementing bidirectional pitch-bending, a convention must be elected regarding the direction of pitch change resulting from a particular direction of stringface side pressure: in a preferred embodiment for two-handed tapping, as taught on the Chapman Stick whereby each hand engages the fingerboard from opposite sides, the pitch is made to increase in response to side pressure toward the center line of the fingerboard and conversely decrease in response to pressure toward either edge. As a benefit of the method of pitch bending taught in the present invention, the shift in pitch is inherently uniform with respect to the side thrust applied to the string-face at any point along the length of the fingerboard, whereas conventional guitar string-stretching technique requires the player to learn how to compensate for large variations in the amount of side pressure required due to inherent limitations and anomalies in the mechanics involved, particularly toward the "nut" end of the fingerboard. The ability of the present invention to bend pitch downward as well as upward eliminates the conventional need for a string tension lever and the need for a free hand to operate such a lever while playing.

Figure 5:
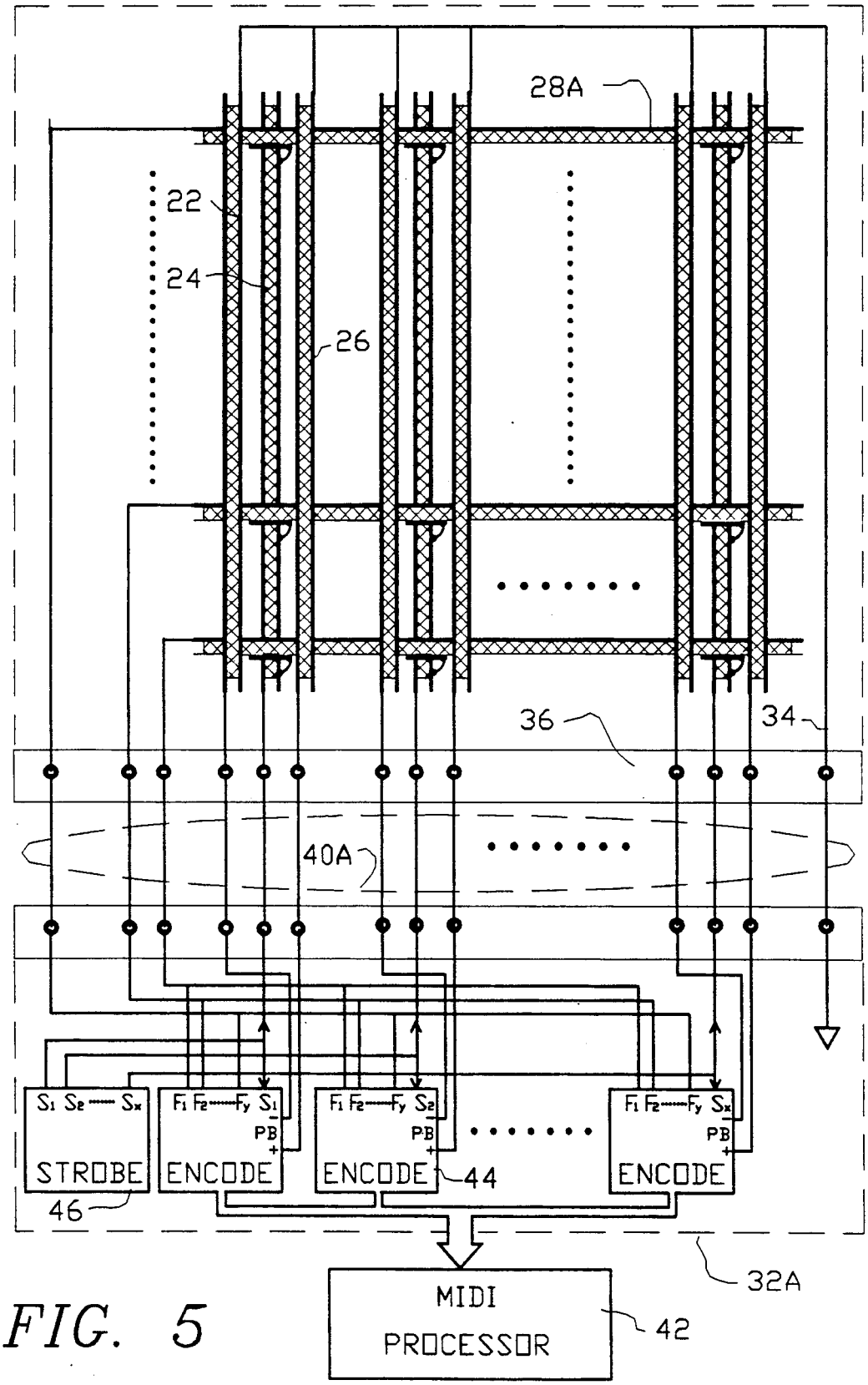
FIG. 5 is a functional block diagram of a series-configured fingerboard controller interfaced to a processor via a bank of strobed string encoder circuits in a second embodiment of the present invention.

FIG. 5 is a simplified functional block diagram showing, as an alternative embodiment to the circuit of FIG. 4, a series connected matrix system of string and fret sensors for selecting pitch. The pitch bend sensor strips 24 and 26 are connected to common ground 34, and operate in parallel.

Encoder 32A comprises a bank of individual string encoder modules 44 each connected to a corresponding string sensor and to all of the fret sensors. A strobe generator 46 provides a group of outputs each connected to the string signal input terminal of a string encoder module 44; these outputs are configured as sequential pulses, each having a duty factor of less than 1/x, where x is the number of simulated strings, so as to sequentially strobe the pulse voltages applied to the string sensors 22. At each intersection of a string sensor 22 and a fret sensor 28A the second terminal of the string sensors 22 is placed in contact with (or otherwise connected to) a short conductive segment on the fret sensor 28A as indicated.

Each fret input terminal of encoders 34 is made to have a predetermined input resistance value. When no string domains are pressed, the high resistance of the sensors limits the current in all branches such that the voltages developed at the fret inputs of encoders 44 are all below a predetermined threshold value, and consequently no input is sensed and no response occurs. When a string-face is depressed at a playing domain, compression of the two sensors at that domain results in a lower resistance thereby developing a signal voltage exceeding the threshold value on the corresponding fret input terminals of encoders 44. Each encoder 44 is commutated by the strobe pulses from strobe generator 46 so as to respond only to fret signals received from the corresponding string, so that each playing domain selected by pressure on a string-face is detected unambiguously, and from this information each encoder 44 determines the intended pitch and sends appropriate MIDI pitch information to the processor 42. Immediately following pitch selection, the fret signal provides amplitude information in the form of a real time analog envelope signal from which the encoder 44 can derive ongoing amplitude parameters and send the appropriate information to the processor 42 in the same manner as described above in connection with FIG. 4. Each encoder 44 receives the + and − pair of pitch-bend inputs and these are processed for pitch bending in the same manner as described above in connection with FIG. 4.

The contact segments on the fret sensors 28A at each intersection with a string sensor 22 are indicated as shown in FIG. 5 for clarity of explanation: in actual implementation these contact segments may be made much smaller or even eliminated as long as a portion of the fret sensor 28A is made to contact a point along the metallized full length contact strip of string sensor 22, at least when the string sensor receives finger pressure.

Since they are functionally segmented, the fret sensors 28A could be alternatively be implemented as a row of individual fret sensor segments, one at each string-face, with one terminal of each sensor segment connected to the common signal bus of that fret, according to the wiring as shown in heavy lines.

As another alternative, instead of being of pressure-sensitive resistive material, fret sensors 28A could be configured simply as conductive strips, held slightly separated from the string sensors 22 such that contact would occur only from finger pressure in a simple binary (off-on switch) action to determine pitch, whereupon the resistance variations and resultant sensed voltage variations originating in the string sensors 22 in response to pressure variations would provide amplitude envelope information to be acted upon by the corresponding encoder 44 as described above.

In any of the embodiments, two further dimensions of fingertip control may be implemented by incorporating fret-bend sensors, flanking each of the fret-faces, adapted to bidirectionally sense fingertip pressure applied to any fret-face along the direction of the string faces. These additional dimensions of fingertip control may be readily utilized to provide proportional control over additional parameters such as timbre, reverberation, echo effects, cross-faders, etc.

The embodiments described above are illustrative of preferred modes of making and practicing the present invention as directed to fully exploiting its advantages to facilitate playing music in a two-handed fingerboard mode, as practiced in connection with The Chapman Stick, and for this purpose is proposed as simulating ten strings along with twenty to twenty five frets.

The concept taught hereby is readily adaptable to any desired number of strings and frets. Many of the advantages of the present invention, particularly in regard to frequency selection and pitch bending, would also benefit the more conventional styles of one-handed fingering on a fretboard. For example, the principles described above are readily adaptable to realize a "six-string" version of the resilient fingerboard controller for either one-handed or two-handed fingering: some of the amplitude control capabilities enabled by this invention could be further modified by techniques customarily contributed by the other hand, or as an alternative the additional degree of control capability introduced by pressure sensitivity as taught by this invention could be utilized for controlling other musical parameters and effects chosen from the large menu available in present day MIDI/synthesizer technology.

As an alternative to the string-faces being raised further than the fret-faces as described above, all the string faces could be raised to a common level.

It would be possible to interchange the two planes in which the string-sensors and the fret-sensors are located between the fingerboard and the rear board since they would both sense applied finger pressure equally well either way.

As an alternative to locating fret sensors between fret-faces as described above, each fret sensor could be located immediately behind a corresponding fret-face. The fingerboard would be adapted to actuate two adjacent fret sensors when finger pressure is applied to the domain between the fret-faces, and the encoder would be adapted to sense the domain by sensing the actuation of the two fret-sensors.

A series type fingerboard controller embodiment may be made to have two-note polyphony on each string, in effect doubling the fingerboard playing area for a two-handed tapping method and allowing a reduction in the number of strings, for example from ten to six, which would accommodate conventional six string guitar techniques as well as the two-handed tapping techniques used by Stick players and by some guitarists.

A more simplified and economical version would utilize a parallel circuit embodiment to provide a "six string" version with two or four note overall polyphony, oriented generally to conventional playing techniques.

In a simplified embodiment requiring only the basic pitch selection and amplitude aspects of the invention, the pitch-bend sensors 24 and 26 (FIGS. 2, 3, 4 and 5) could be eliminated for simplicity and economy, and pitch bending could be implemented by alternate means such as a pitch bend wheel, lever or pedal.

A pair of fingerboards of this invention, each made shorter and with fewer frets, may be installed upon a single longer rear board structure adapted for the two-handed tapping technique, whereby a reduced number of string faces, for example simulating six guitar strings, is doubled in concept as the player uses two hands, one on each fingerboard.

The invention may be embodied and practiced in other specific forms without departing from the spirit and essential characteristics thereof. The present embodiments are therefore to be considered in all respects as illustrative and not restrictive, the scope of the invention being indicated by the appended claims rather than by the foregoing description; and all variations, substitutions and changes which come within the meaning and range of equivalency of the claims are therefore intended to be embraced therein.

What is claimed is:

1. An elongated fingerboard, for use in musical performance as a controller for electronic encoding/processing means, comprising:

a plurality of spaced, substantially parallel, longitudinal string-faces, integral with the fingerboard, disposed in a first plane parallel to a rear surface of said fingerboard so as to simulate, for tactile fingering purposes, strings of a conventional stringed type musical instrument;

a plurality of elongated string sensors, disposed parallel to said string-faces in a second plane located between the first plane and the rear surface, each string sensor being disposed between a corresponding string-face and the rear surface and being made electrically responsive to pressure applied to the corresponding string-face;

a plurality of fret sensors, disposed substantially perpendicular to said string-faces in a third plane between the first plane and the rear surface, said fret sensors traversing said string sensors at an array of intersections, each of said fret sensors being made electrically responsive to pressure applied to any one of said string-faces in the vicinity of a string-face/fret sensor intersection, the string-faces, in a quantity of x, and the fret-sensors, in a quantity of y, defining an x by y array of playing domains, each located at a unique string-face/fret sensor intersection and each assigned a predetermined musical pitch value; and electrical conductor and connector means delivering signals from said string sensors and said fret sensors to the electronic encoding/processing means, the signals identifying each domain selected by a player applying pressure thereto, thus enabling the encoding/processing means to accordingly synthesize a musical note having a musical pitch value corresponding to the domain selected.

2. The fingerboard as defined in claim 1 further comprising a plurality of fret-faces, incorporated in said fingerboard to simulate a conventional fretted musical instrument for purposes of enabling a player to locate said fret sensors by tactile fingering and/or by sight, each fret-face comprising a colinear row of elongated fret-face members, each member being disposed transversely between adjacent ones of said string-faces, said fret-faces being in a designated systematic manner relative to said fret sensors and disposed in a plane parallel to the rear surface of said fingerboard.

3. The fingerboard as defined in claim 2 wherein the plane of said fret-faces is located between the plane of said string faces and the rear surface of said fingerboard.

4. The fingerboard as defined in claim 2 further comprising an elongated substantially rectangular rigid rear board portion having a front-facing mounting surface, the fingerboard being made integrally from resilient material and attached at a rear surface thereof to the mounting surface so as to provide at each playing domain an operative pressure path encompassing an operative portion of one of said string faces, one of said string sensors, one of said fret sensors and an operative portion of said mounting surface, said mounting surface being structured so as to counterconstrain pressure applied by a player in selecting a domain of a string face, causing the pressure to act upon a corresponding active portion of a string sensor and of a fret sensor, so as to thereby cause a string sensor signal and a fret sensor signal to be transmitted to the encoder/processor for purposes of identifying the selected domain and assigning a corresponding pitch value to a resultant synthesized musical note.

5. The fingerboard as defined in claim 4 wherein each domain occupies a distance along the string-face of at least half the distance between adjacent fret-faces.

6. The fingerboard as defined in claim 1 wherein each of said string sensors is made able to provide a dynamic signal proportional to pressure applied to a portion of a corresponding string-face, and wherein said electronic encoding and processing means is made able to encode and process amplitude envelope data in real time so as to effect a predetermined relationship between dynamic pressure applied in playing a selected note on the fingerboard and a resultant amplitude envelope of a corresponding synthesized musical note.

7. The fingerboard as defined in claim 1 further comprising, in said fingerboard:

a plurality, equal in number to said plurality of string-faces, of elongated string-bend sensor pairs, each pair flanking one of said string-faces, one of each pair being made responsive to pressure applied in a domain of an associated string-face in a first lateral direction against the string-face, and the other of the pair being made responsive to pressure applied to the domain of the string-face in a second lateral direction opposite the first direction; and electrical conductor/connector means for delivering signals from said string-bend sensors to the electronic encoding/processing means, the encoding/processing means being made immediately responsive to signals received from said string-bend sensors in a manner to vary the pitch of a synthesized musical note in proportion to the applied pressure.

8. The fingerboard as defined in claim 1 further comprising, in said fingerboard:

a plurality, equal in number to said plurality of fret-faces, of elongated fret-bend sensor pairs, each pair flanking one of said fret-faces, one of each pair being made responsive to pressure applied to the fret-face in a first direction along the string-faces, and the other of the pair being made responsive to pressure applied to the fret-face in a second direction along the string-faces, opposite the first direction; and electrical conductor/connector means for delivering signals from said fret-bend sensors to the electronic encoding/processing means, the encoding/processing means being made immediately responsive to signals received from said fret-faces in a manner to modify selected parameters of synthesized musical notes in proportion to the applied pressure.

9. An electronic musical instrument comprising;

an elongated fingerboard having a plurality of spaced, substantially parallel, longitudinal string-faces, integral with the fingerboard, disposed in a first plane parallel to a rear surface of said fingerboard so as to simulate, for tactile fingering purposes, strings of a conventional stringed musical instrument such as a guitar;

a plurality of elongated string sensors, disposed parallel to said string-faces in a second plane located between said first plane and the rear surface, each string sensor being disposed between a corresponding string-face and the rear surface and being made electrically responsive to pressure applied to the corresponding string-face;

a plurality of fret sensors, disposed substantially perpendicular to said string-faces in a third plane between said first plane and the rear surface, said fret sensors traversing said string sensors at an array of intersections, each of said fret sensors being made electrically responsive to pressure applied to any one of said string-faces in the vicinity of a string-face/fret-face sensor intersection, the string-faces, in a quantity of x, and the fret sensors, in a quantity of y, defining an x by y array of playing domains, each located at a unique string-face/fret-face sensor intersection and each assigned a predetermined musical pitch value;

electrical conductor/connector means including a common bus circuit connected to a first terminal of each of said string sensors and to a first terminal of each of said fret sensors, a plurality of signal circuits each connected separately to a second terminal of each of said string sensors, and a plurality of signal circuits each connected separately to a second terminal of each of said fret sensors;

an encoder connected to said conductor/connector means, having ability to identify, from input received thereby, each domain of the fingerboard as selected by a player applying pressure to a string-face within the domain, and to generate a music processor command signal ordering a pitch value corresponding to the domain selected; and a music signal processor, connected to said encoder so as to receive input therefrom, having ability to respond to the encoder command signal by producing a synthesized musical note having the pitch value ordered by the encoder.

10. An electronic musical instrument comprising;

an elongated fingerboard having a plurality of spaced, substantially parallel, longitudinal string-faces, integral with the fingerboard, disposed in a first plane parallel to a rear surface of said fingerboard so as to simulate, for tactile fingering purposes, strings of a conventional stringed musical instrument such as a guitar;

a plurality of elongated string sensors, disposed parallel to said string-faces in a second plane located between said first plane and the rear surface, each string sensor being disposed between a corresponding string-face and the rear surface and being made electrically responsive to pressure applied to the corresponding string-face;

a plurality of fret sensor rows, disposed substantially perpendicular to said string-faces in a third plane between said first plane and the rear surface, each of said fret sensor rows comprising a set of separated fret sensor segments each adjacent to one of said string sensors, the sensor segments forming an array of intersections, each of said fret sensor segments being made electrically responsive to pressure applied to the adjacent string sensor; the string-faces, in a quantity of x and the fret sensor rows, in a quantity of y, defining an x by y array of playing domains, each associated with a fret sensor segment and each assigned a predetermined musical pitch value, each of said fret sensor segments having a first terminal connected to a first terminal of an adjacent string sensor and each of the fret sensor rows having a separate fret signal bus connected in common to a second terminal of each of the sensor segments in the row;

electrical conductor/connector means including a plurality of conductors each connected separately to a second terminal of each of said string sensors and a plurality of conductors each connected separately to each of the fret signal buses;

an encoder bank connected to said conductor/connector means, having ability to identify, from input received thereby, domains of the fingerboard as selected by the player applying pressure to the domains spaced along the string-faces, and to accordingly originate processor commands ordering pitch values corresponding to the domains selected; and a music signal processor, connected to said encoder bank so as to receive the processor commands therefrom, having ability to respond to the commands by assigning to synthesized musical notes the pitch values ordered by the encoder bank.

11. The musical instrument as defined in claim 10 wherein said encoder bank comprises:

a plurality of encoder circuits, associated one-on-one with said string-faces, each connected one-on-one to a corresponding string sensor via a second terminal thereof, and each having a plurality of input terminals connected separately to each of the fret signal buses;

a strobe module activating each of said encoder circuits in a recurring sequence so as to enable each encoder circuit to identify pressure-selected domains of the associated string-face from inputs received from the fret sensor segments spaced along the associated string sensor, and to accordingly deliver music commands to the processor ordering pitch values corresponding to the domains selected.

* * * * *

UNITED STATES PATENT AND TRADEMARK OFFICE

CERTIFICATE OF CORRECTION

PATENT NO. : 5,140,887

DATED : August 25, 1992

INVENTOR(S) : Emmett H. Chapman

It is certified that error appears in the above-indentified patent and that said Letters Patent is hereby corrected as shown below:

Column 8, line 47, delete "34" and insert --44--.

Column 9, line 68, delete "could be raised to" and insert --and fret-faces could be located at--.

IN THE DRAWINGS

In FIG.4 and FIG. 5: interchange reference numberals 22 and 24 so that numeral 22 points out the central one of the group of three sensor strips and numeral 24 points out the left hand one.

Signed and Sealed this

Twenty-eighth Day of December, 1993

*Attest:*

Bruce Lehman

BRUCE LEHMAN

*Attesting Officer*

*Commissioner of Patents and Trademarks*